US012357075B2

(12) United States Patent
Yuan et al.

(10) Patent No.: US 12,357,075 B2
(45) Date of Patent: Jul. 15, 2025

(54) COSMETICS CONTAINER

(71) Applicant: SHANGHAI ZHENCHUN COSMETICS CO., LTD, Shanghai (CN)

(72) Inventors: Jiuwei Yuan, Shanghai (CN); Feng Zhou, Shanghai (CN); Hong Shen, Shanghai (CN); Xiaohua Cui, Shanghai (CN); Sili Zeng, Shanghai (CN); Ying Yang, Shanghai (CN)

(73) Assignee: SHANGHAI ZHENCHUN COSMETICS CO., LTD, Shanghai (CN)

( * ) Notice: Subject to any disclaimer, the term of this patent is extended or adjusted under 35 U.S.C. 154(b) by 868 days.

(21) Appl. No.: 17/905,239

(22) PCT Filed: Dec. 16, 2019

(86) PCT No.: PCT/CN2019/125679
§ 371 (c)(1),
(2) Date: Aug. 29, 2022

(87) PCT Pub. No.: WO2020/233109
PCT Pub. Date: Nov. 26, 2020

(65) Prior Publication Data

US 2023/0139200 A1 May 4, 2023

(30) Foreign Application Priority Data

May 17, 2019 (CN) ..... 201910414267.8

(51) Int. Cl.
*A45D 40/10* (2006.01)
*A45D 33/00* (2006.01)
(Continued)

(52) U.S. Cl.
CPC ..... *A45D 40/10* (2013.01); *A45D 33/006* (2013.01); *A45D 40/12* (2013.01); *A45D 40/24* (2013.01)

(58) Field of Classification Search
CPC ..... A45D 40/10; A45D 40/12; A45D 40/24; A45D 33/006
See application file for complete search history.

(56) References Cited

U.S. PATENT DOCUMENTS 9,839,277 B2 * 12/2017 Lefevre ..... A45D 34/043

FOREIGN PATENT DOCUMENTS

CN 105852386 A 8/2016
CN 205456883 U 8/2016
(Continued)

*Primary Examiner* — Jennifer C Chiang
(74) *Attorney, Agent, or Firm* — NKL Law; Allen Xue

(57) ABSTRACT

A cosmetics container includes a housing, a bottom sleeve, an inner bottom, a lower elastic element, a button, and a middle sleeve thereof. The pressing area is provided on the housing. The bottom sleeve is provided inside of the housing, and the inner bottom is provided inside of the bottom sleeve. The lower elastic element is provided inside of the bottom sleeve and is located at a lower surface of the inner bottom. The middle sleeve is provided inside of the housing and is located at an upper surface of the inner bottom. The middle sleeve is provided with an upper elastic element, which abuts against the button. The button includes an upper rim, a pressing piece, and a lower rim thereof. The pressing piece is located in the middle between the upper rim and the lower rim and is provided at the pressing area.

9 Claims, 2 Drawing Sheets

(51) Int. Cl.
*A45D 40/12* (2006.01)
*A45D 40/24* (2006.01)

(56) References Cited

FOREIGN PATENT DOCUMENTS

| | | | | | |
|---|---|---|---|---|---|
| CN | 106798391 | A | | 6/2017 | |
| CN | 110074541 | A | | 8/2019 | |
| DE | 202020106784 | U1 | * | 1/2021 | |
| FR | 2928629 | A1 | * | 9/2009 | ..... A45D 40/00 |
| FR | 2982132 | A1 | * | 5/2013 | ..... A45D 40/10 |
| JP | H07231812 | A | | 9/1995 | |
| KR | 20200127363 | A | * | 11/2020 | |
| WO | 2012115461 | A2 | | 8/2012 | |

* cited by examiner

COSMETICS CONTAINER

TECHNICAL FIELD

The present invention relates to a container, in particular to a cosmetics container.

BACKGROUND

Common cosmetic containers are can-shaped, box-shaped or branch-shaped. Among them, branch-shaped containers are commonly used for lipstick and mascara. Take lipstick as an example. Lipstick is a kind of lip beauty cosmetics, including lippie, lip stick, lip gloss, lip sleeve, etc. It can make the lips rosy and shiny, and has the effect of moisturizing and protecting the lips. A conventional cosmetic container is mainly composed of a middle bundle and a lid, wherein the middle bundle is provided with a liftable bracket. The lipstick is arranged on the bracket, and the middle bundle and the lid are connected by snaps or threads. When the middle bundle and the lid are connected by the snaps, the tightness of the snaps is not easy to control. If it is loose, the middle bundle and the lid may be accidentally separated due to the shaking during carrying. If it is tight, it is easy to leave hands due to the great force required for separation, and it is inconvenient to operate. when the middle buddle and the lid are connected by threads, the rotation and separation may cause misoperation, that is, before the middle buddle and the lid are not separated, the bracket in the middle buddle rises, and the shaking while carrying may cause the middle buddle to accidentally separate from the lid.

SUMMARY

In view of the above-mentioned defects of the prior art, the technical problem to be solved by the present invention is to provide a cosmetic container, which has a push function.

In order to achieve the above purpose, the present invention provides a cosmetic container comprising a housing, a bottom sleeve, an inner bottom, a lower elastic element, a button, and a middle sleeve thereof, wherein the housing is provided with a pressing area, the bottom sleeve is provided inside of the housing, and the inner bottom is provided inside of the bottom sleeve; the lower elastic element is provided inside of the bottom sleeve and is located below the inner bottom; the middle sleeve is provided inside of the housing and is located above the inner bottom; the middle sleeve is provided with an upper elastic element which abuts against the button, and the button comprises an upper rim, a pressing piece, and a lower rim thereof; the pressing piece is located in the middle between the upper rim and the lower rim and is provided at the pressing area.

The pressing area is set as a window.

The cosmetic container further comprises a middle buddle, and the middle buddle is arranged in the housing. The cosmetic container further comprises a lower magnet, and the lower magnet is provided inside of the bottom sleeve and is located under the inner bottom, and a lower end of the middle buddle is provided with an upper magnet or made of magnetic material.

The bottom sleeve is provided with a limiting groove, the inner bottom is provided with a protruding limiting rib matching with the limiting groove, and the limiting rib is embedded in the limiting groove.

The lower elastic element is a spring or an elastic sheet.

The upper elastic element is a spring or an elastic sheet.

The middle sleeve is further provided with a protruding limiting block.

The cosmetic container further comprises an ornament table, and the ornament table is arranged on an upper end of the middle buddle.

The cosmetic container further comprises a weighting block, and the weighting block is arranged in the bottom sleeve and is located below the inner bottom.

The cosmetic container of the present invention has a push function through the button and the lower elastic element, and the operation is simple, only pressing the button, no need to pull out or rotate, having a strong sense of experience.

The concept, specific structure and technical effects of the present invention will be further described below in conjunction with the accompanying drawings, so as to fully understand the purpose, characteristics and effects of the present invention.

DETAILED DESCRIPTION

The present invention will be further elaborated below in conjunction with the accompanying drawings.

Figure 1:
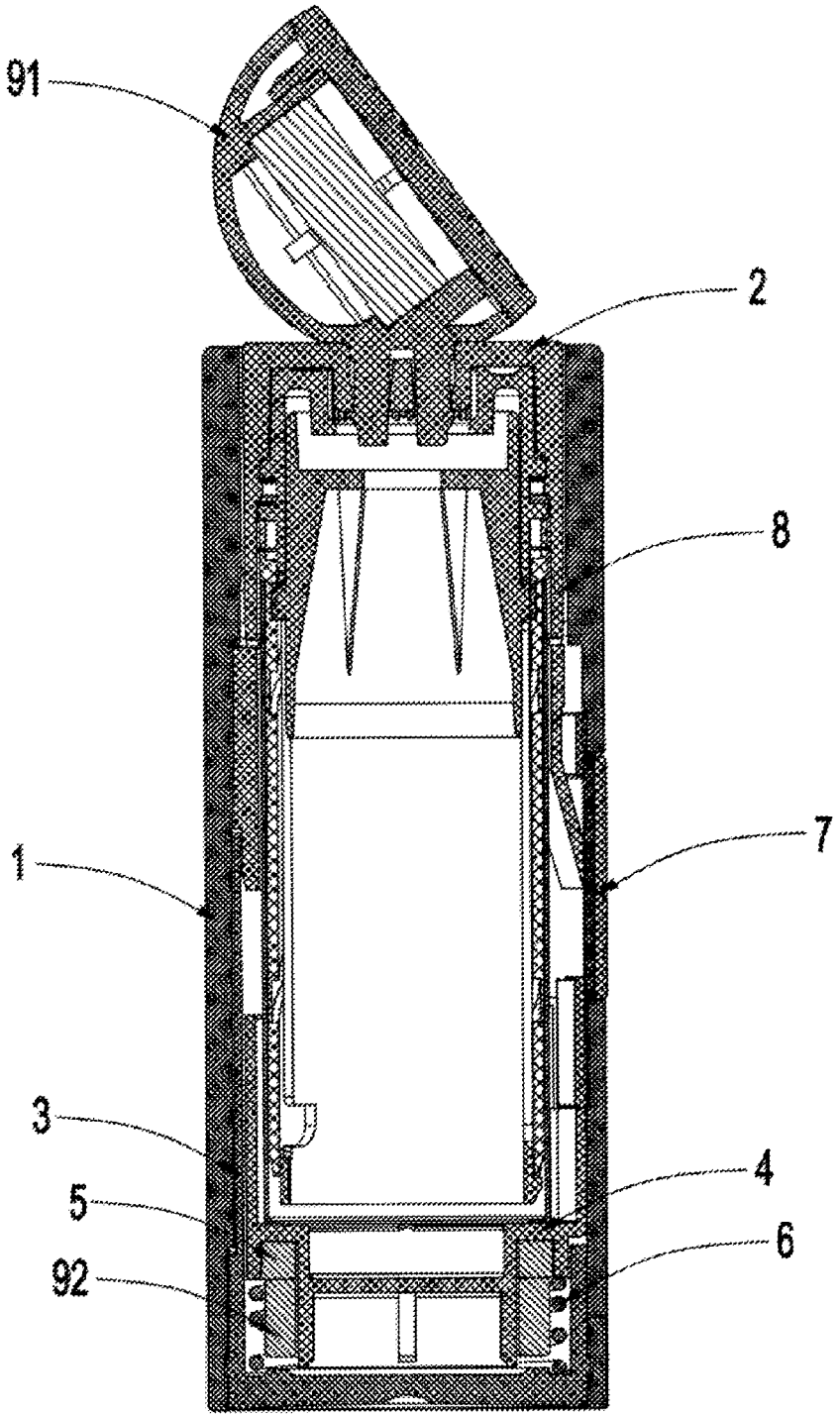
FIG. 1 is a side sectional view of the cosmetic container of the present invention.
Figure 2:
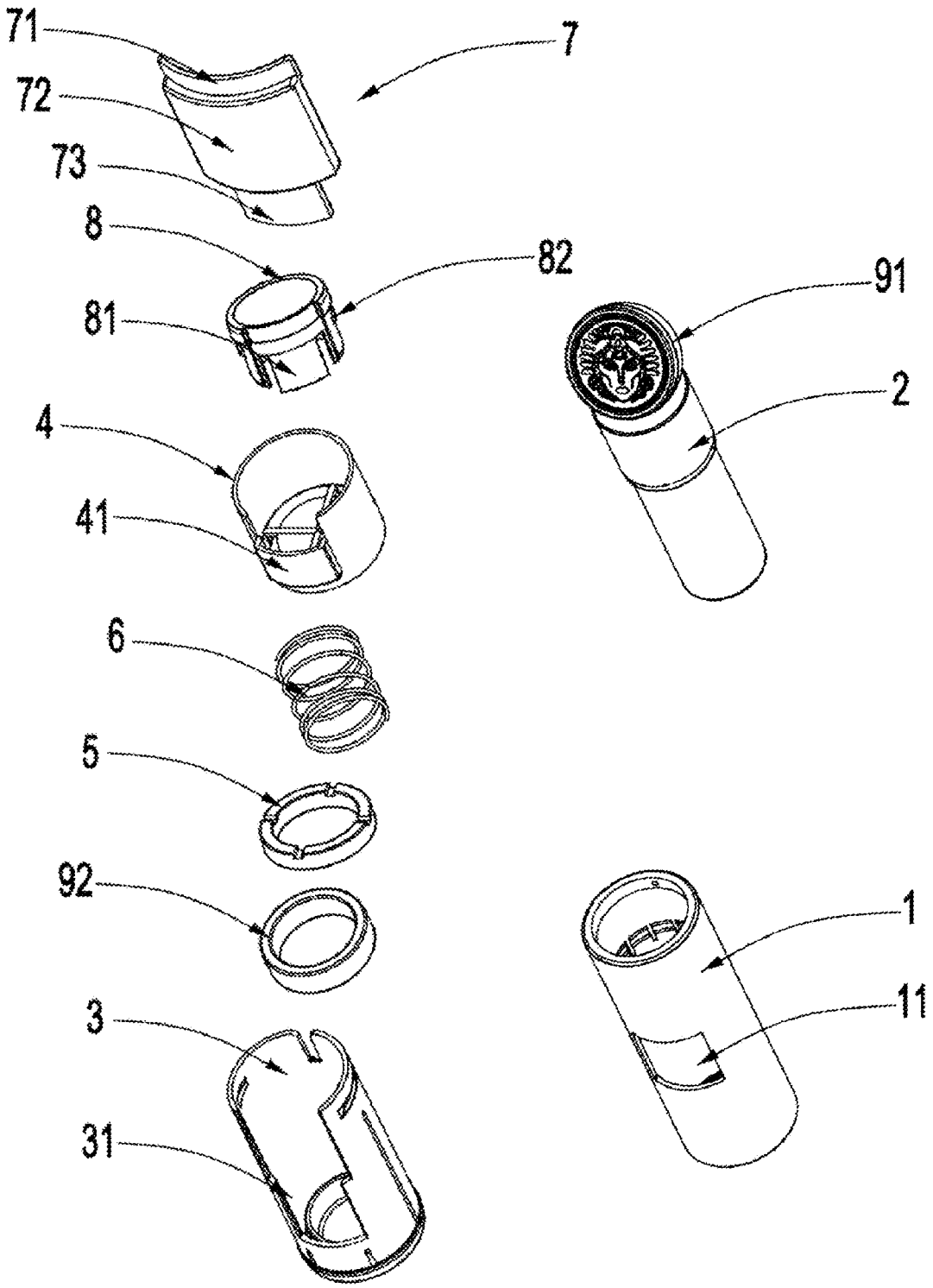
FIG. 2 is an exploded view of the cosmetic container of the present invention.

As shown in FIG. 1, the present invention provides a cosmetic container including a housing 1, a middle buddle 2, a bottom sleeve 3, an inner bottom 4, a lower magnet 5, a lower elastic element 6, a button 7, and a middle sleeve 8. The housing 1 is provided with a pressing area, which can be set as a window 11, or can be made of soft materials, such as rubber or leather, so that when the pressing area is pressed, the pressing area can be deformed, that is, inwardly recessed. The middle buddle 2 is placed in the housing 1 for placing lipstick. The bottom sleeve 3 is provided inside of the housing 1. The inner bottom 4 is provided inside of the bottom sleeve 3. The lower magnet 5 and the lower elastic element 6 are both provided inside of the bottom sleeve 3 and located below the inner bottom 4. The button 7 can be pressed against the inner bottom 4. The middle sleeve 8 is provided inside of the housing 1 and located above the inner bottom 4. The middle sleeve 8 is provided with an upper elastic element 81, and the upper elastic element 81 are pressed against the button 7, so that the button 7 abuts against the pressing area, that is, the button 7 can be pressed through the pressing area.

A lower end of the middle buddle 2 is provided with an upper magnet or is made of magnetic material thereof, so as to generate a magnetic attraction to the lower magnet 5.

The bottom sleeve 3 is provided with a limiting groove 31. The inner bottom 4 is provided with a protruding limiting rib 41 matching with the limiting groove 31, and the limiting rib 41 is embedded in the limiting groove 31, so that the inner bottom 4 can only move up and down along the limiting groove 31 and cannot rotate.

The lower elastic element 6 can be a spring or an elastic sheet. Similarly, the upper elastic element 81 can be a spring or an elastic sheet.

The button 7 includes an upper rim 71, a pressing piece 72, and a lower rim 73. The pressing piece 72 is located in the middle between the upper rim 71 and the lower rim 73 and is provided at the pressing area. The upper rim 71 plays a fixed role, so that the button 7 cannot be moved up or down.

The middle sleeve 8 is also provided with a protruding limit block 82 for further limiting the inner bottom 4 and increasing the overall stability.

The cosmetic container further comprises an ornament table 91 and a weighting block 92, wherein the ornament table 91 is arranged on an upper end of the middle buddle 2 for placing ornaments, in order to distinguish different lipsticks and increase beautiful degree of appearance. The weighting block 92 is arranged inside the bottom sleeve 3 and located below the inner bottom 4, used to lower the barycenter of the cosmetic container and increase the stability.

When the cosmetic container is in a closed state (ie, not be used), the middle buddle 2 is embedded in the housing 1, and the lower end of the middle buddle 2 is pressed against the inner bottom 4, close to the lower magnet 5, and the lower elastic element 6 is in the pressed state and give an upward force to the inner bottom 4, but the lower rim 73 is under the force of the upper elastic element 81 (that is, the upper elastic element 81 is pressed against the button 7, and the pressing piece 72 is tightly touching the pressing area), so that the lower rim 73 and the inner bottom 4 are on the same surface in the vertical direction, that is, the lower rim 73 is pressed against the inner bottom 4, and the inner bottom 4 cannot be moved upward. At the same time, due to the magnetic attraction of the lower magnet 5, the middle buddle 2 is magnetically attracted in the housing 1 and cannot be separated naturally.

When the cosmetic container needs to be opened, it is only necessary to press the pressing piece 72, so that the lower rim 73 and the inner bottom 4 are partially misaligned (ie, not on the same surface in the vertical direction), and the lower rim 73 cannot bear against the inner bottom 4. The inner bottom 4, due to the force of the lower elastic element 6, will overcome the magnetic attraction force of the middle buddle 2 and the lower magnet 5 to move upward, thereby driving the middle buddle 2 to move upward, producing a push effect. When the inner bottom 4 moves upward to a certain position, it will be double restricted by the pressing piece 72 and the limiting block 82 to prevent the inner bottom 4 from moving upward. At this time, even if the lower end of the middle buddle 2 is far away the lower magnet 5, but since there is still a magnetic attraction between the middle buddle 2 and the lower magnet 5 and the middle buddle itself has a certain weight, most of the middle buddle 2 will still be in the housing 1, and will not be completely disengaging from the housing 1. The user can take out the middle bundle 2 with only a small force, and then unscrew the lipstick from the middle buddle 2 for use.

When the cosmetic container needs to be closed, it is only necessary to press the middle bundle 2 into the housing 1, and the lower end of the middle bundle 2 will abut against the inner bottom 4, so that the inner bottom 4 moves downward, and when the inner bottom 4 moves down to a certain position, since the button 7 has been subjected to the force of the upper elastic element 81, the lower rim 73 will be on the same surface as the part of the inner bottom 4 in the vertical direction, that is, the lower rim 73 pressing against the inner bottom 4, at this time, the inner bottom 4 and the middle buddle 2 are stably restrained, and will not be accidentally detached due to the shaking during carrying.

It is worth reminding that the middle bundle can also be replaced with other cosmetic carriers, such as a mascara brush, and, when the cosmetic container is in a closed state, the middle bundle can also be limited in the housing by means of snaps, that is, magnetic attraction is not the only way.

The preferred embodiments of the present invention have been described in detail above. It should be understood that those skilled in the art can make many modifications and changes according to the concept of the present invention without creative efforts. Therefore, any technical solutions that can be obtained by those skilled in the art through logical analysis, reasoning or limited experiments on the basis of the prior art according to the concept of the present invention shall fall within the protection scope determined by the claims.

The invention claimed is:

1. A cosmetic container comprising a housing, a bottom sleeve, an inner bottom, a lower elastic element, a button, and a middle sleeve thereof, wherein:

the housing is provided with a pressing area, the bottom sleeve is disposed inside the housing, and the inner bottom is disposed inside the bottom sleeve;

the lower elastic element is disposed inside the bottom sleeve and is located below the inner bottom;

the middle sleeve is disposed inside the housing and is located above the inner bottom;

the middle sleeve is further provided with an upper elastic element which abuts against the button, and the button comprises an upper rim, a pressing piece, and a lower rim thereof;

the pressing piece is disposed between the upper rim and the lower rim and is provided at the pressing area; and the bottom sleeve is provided with a limiting groove, the inner bottom is provided with a protruding limiting rib matching with the limiting groove, and the limiting rib is embedded in the limiting groove.

2. The cosmetic container of claim 1, wherein the pressing area is set as a window.

3. The cosmetic container of claim 1, further comprising a middle buddle, wherein the middle buddle is arranged in the housing.

4. The cosmetic container of claim 3, further comprising a lower magnet, wherein the lower magnet is disposed inside the bottom sleeve and is located under the inner bottom, and a lower end of the middle buddle is made of a magnetic material.

5. The cosmetic container of claim 3, further comprising an ornament table, wherein the ornament table is arranged on an upper end of the middle buddle.

6. The cosmetic container of claim 1, wherein the lower elastic element is a spring or an elastic sheet.

7. The cosmetic container of claim 1, wherein the upper elastic element is a spring or an elastic sheet.

8. The cosmetic container of claim 1, wherein the middle sleeve is further provided with a protruding limiting block.

9. The cosmetic container of claim 1, further comprising a weighting block, wherein the weighting block is arranged in the bottom sleeve and is located below the inner bottom.

* * * * *